United States Patent [19]

Jennings, Jr.

[11] Patent Number: 4,711,302

[45] Date of Patent: Dec. 8, 1987

[54] GRAVEL PACK VOID SPACE REMOVAL VIA HIGH ENERGY IMPULSE

[75] Inventor: Alfred R. Jennings, Jr., Plano, Tex.

[73] Assignee: Mobil Oil Corporation, New York, N.Y.

[21] Appl. No.: 900,466

[22] Filed: Aug. 25, 1986

[51] Int. Cl.[4] ..... E21B 43/04; E21B 43/00; E21B 47/10

[52] U.S. Cl. ..... 166/250; 166/278; 166/299

[58] Field of Search ..... 166/63, 278, 299, 311, 166/250, 255

[56] References Cited

U.S. PATENT DOCUMENTS 4,039,030 8/1977 Godfrey et al. ..... 166/299
4,064,935 12/1977 Mohaupt ..... 166/63
4,081,031 3/1978 Mohaupt ..... 166/63 X
4,343,356 8/1982 Riggs et al. ..... 166/63 X

*Primary Examiner*—George A. Suchfield
*Attorney, Agent, or Firm*—A. J. McKillop; M. G. Gilman; C. A. Malone

[57] ABSTRACT

Voids in a gravel pack, particularly in deviated wellbores, are substantially eliminated via a process which utilizes a high energy impulse device. Said device is lowered into the vicinity of the voids and detonated thereby causing turbulence through the screen or slotted liner which causes a re-adjustment of the pack. Energy from said device can be tailored to allow considerable agitation to the gravel pack and screen without destroying said screen.

26 Claims, 2 Drawing Figures

GRAVEL PACK VOID SPACE REMOVAL VIA HIGH ENERGY IMPULSE

FIELD OF THE INVENTION

This invention concerns gravel packs used to remove fines from hydrocarbonaceous fluids produced from a subterranean formation. More specifically, it concerns the removal of void spaces ("holidays") from gravel packs.

BACKGROUND OF THE INVENTION

Effective placement of gravel packs is difficult, especially in deviated wellbores. Since viscous gels are usually used to transport the gravel during placement, the gravel has been observed (in model studies) to aggregate and concentrate in some areas while in other areas the gravel remains suspended until the gel breaks. Once the gel breaks, the reduction in viscosity allows the suspended gravel to settle leaving void spaces in the gravel pack (known as "holidays").

When producing hydrocarbonaceous fluids from a subterranean formation, formation fines accumulate in the void spaces. Accumulation of fines in said spaces causes a loss of efficiency resulting in reduced production capacity. Continued loss of production capacity eventually leads to the well being shut down and the gravel pack being replaced. Unscheduled gravel pack replacement increases operating costs. Therefore, what is needed is an effective means of repacking a gravel pack in situ to remove void spaces.

SUMMARY OF THE INVENTION

A high energy impulse device is used for removing void spaces in an in-casing gravel pack which pack is thereafter used in producing hydrocarbonaceous fluids from a subterranean formation. In the practice of this invention, a high energy impulse device is placed in close proximity to a void space containing in-casing gravel pack which pack encompasses the perforated interval of the production string. Said impulse device is placed within the production string near a void space within said gravel pack. Upon ignition said device generates energy sufficient to cause turbulence and agitation of gravel within said pack. This turbulence and agitation are sufficient to readjust and consolidate gravel within said pack.

Said pack is then tested for the presence of an additional void space. If an additional void space is determined to be present within said pack, another high energy impulse device is properly positioned and ignited. Afterwards, said pack is again tested for a void space. If a void is determined, the procedure is repeated until all void spaces are removed from said pack and the gravel therein readjusted and consolidated.

Although sufficient to remove voids from said pack, the generated energy does not fracture the formation. Neither does the generated energy damage said pack, wellbore, production string assembly, or other downhole equipment used to produce hydrocarbonaceous fluids from said formation.

It is therefore an object of this invention to provide an efficient and novel method to remove voids from in-casing gravel packs used in producing hydrocarbonaceous fluids from a subterranean formation.

It is a yet further object of this invention to remove voids from in-casing gravel packs without damaging said pack, wellbore, or other equipment used in producing hydrocarbonaceous fluids from a subterranean formation.

It is a still yet further object of this invention to provide an effective method of repacking an in-casing gravel pack in situ to minimize production delays and costs.

DESCRIPTION OF THE PREFERRED EMBODIMENTS

Figure 2:
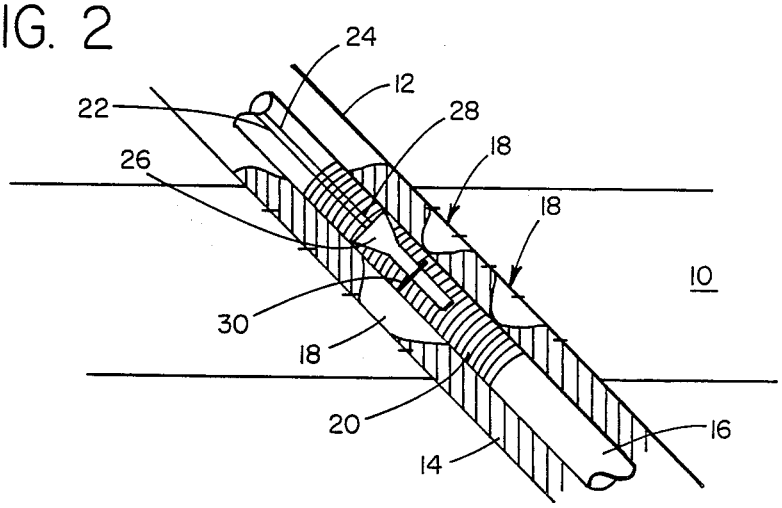
FIG. 2 is a longitudinal cross section of an in-casing gravel pack having void spaces therein. Said pack encompasses a perforated production string within a well located in a subterranean formation. Contained within said production string, near the void spaces, is a high energy impulse device.

In the practice of this invention, referring to FIG. 2, a high energy impulse device 26 containing a propellant is placed into a wellbore 12 which penetrates a hydrocarbonaceous fluid producing formation 10. Said device 26 is suspended into wellbore 12 via a retrieval means, which generally will be a cable 22. In order to ignite the propellant contained in said device 26, a means for igniting 24 the propellant is connected to retainer stem 28. Retainer stem 28 forms an integral part of the canister and is positioned on its upwardly directed end. The other end of a means for ignition 24 is connected or affixed to a location at or above ground level above wellbore 12. The means for ignition 24 will generally be a conduit 24 containing an electrical wire which wire can be used to generate an electrical spark within device 26 containing the propellant.

Figure 1:
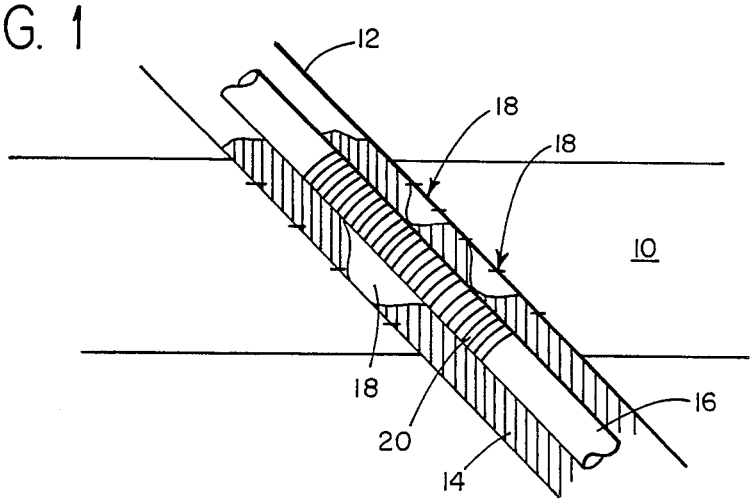
FIG. 1 is a longitudinal cross section of an in-casing gravel pack having void spaces therein. Said pack encompasses a perforated production string within a well located in a subterranean formation.

Device 26, as shown in FIG. 2, is positioned into perforated production string assembly 16 adjacent to gravel pack 14 which contains void spaces 18. Although wellbore 12 as shown in FIG. 2 is deviated, this invention can work in substantially vertical wellbores when needed. In order to properly position device 26 within production string assembly 16, a centralizer is placed around said device. Via this centralizer 30, proper positioning can be maintained to concentrate the energy released upon igniting device 26 into void space 18. As is shown in FIG. 1, void spaces 18 have formed in gravel pack 14. If these void spaces are not removed, fines will accumulate within said spaces causing a loss of production capacity. Wire wrapped screen 20 is used to prevent the gravel in gravel pack 14 from entering production string assembly 16 via perforations contained in said assembly.

Void spaces 18 as shown in FIGS. 1 and 2 can be detected by various logging techniques which are available from service companies such as Schlumberger, Dresser Atlas, and others. One such means for determining void spaces would be Schlumberger's BHC (Borehole Compensated) Sonic Log available from Schlumberger, Ltd., New York, N.Y.

Once the high energy device 26 has been positioned as desired within production string assembly 16, the device is ignited. Energy released upon ignition of said device causes turbulence through perforations in production string assembly 16. This turbulence shakes gravel pack 14 thereby causing the gravel therein to move and fill void spaces 18. This movement causes a readjustment of gravel within said pack 14 thereby consolidating said gravel with an attendant removal of void spaces 18. Energy released from device 26 is sufficient to allow considerable agitation of wire wrapped screen 20, gravel pack 14, and production string assembly 16 without destroying said screen 20, causing damage to other downhole equipment, or formation 10.

After dissipation of pressure and heat within string assembly 16, any remaining debris from device 26 can be removed from wellbore 12 via retrieval means 22. Later, a technique as mentioned above can be utilized to determine if all void spaces have been removed from said pack. If void spaces remain, the method of this invention can be repeated until all void spaces have been removed. Thereafter, formation 10 and string assembly 16 can be cleaned up as needed and production resumed.

A high energy impulse device 26 which can be used in the method of this invention is purchasable from Servodynamics, Inc. located in Englewood, Colo. Geoffrey et al., in U.S. Pat. No. 4,039,030 teach a method and device for generating high impulse energy. This patent is hereby incorporated by reference. As will be apparent to those skilled in the art, the propellant utilized will need to be tailored to meet the environmental dictates of the formation and production equipment.

The propellant in the device 26 can belong to the modified nitrocellulose or the modified and unmodified nitroamine propellant class. Suitable solid propellants capable of being utilized include a double-based propellant known as M-5. It contains nitroglycerine and nitrocellulose. Another suitable propellant is a composite propellant which contains ammonium perchlorate in a rubberized binder. The composite propellant is known as HXP-100 and is purchasable from the Holex Corporation of Hollister, Calif. M-5 and HXP-100 propellants are disclosed in U.S. Pat. No. 4,039,030 issued to Godfrey et al.

A M-5 solid propellant was utilized by C. F. Cuderman in an article entitled "High Energy Gas Fracturing Development," Sandia National Laboratories, SAND 83-2137, October 1983. This article is also incorporated reference.

As is known to those skilled in the art, the amount of heat and pressure produced is dependent upon the kind of propellant used, its grain size and geometry. Heat and pressure generation also depends upon the burning rate, weight of charge and the volume of gases generated. Pressures generated are expected to be about 1,000 to about 10,000 psig.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

I claim:

1. A high energy impulse method for removing voids in an in-casing gravel pack used in producing hydrocarbonaceous fluids from a subterranean formation comprising:

(a) placing within a well, a high energy impulse device in proximity to a void containing in-casing gravel pack which encompasses a perforated production string; and (b) igniting said device which device upon ignition generates energy sufficient to cause turbulence within said gravel pack sufficient to consolidate gravel within said pack and remove voids therefrom without fracturing the formation, damaging the pack or production string assembly thereby consolidating said pack.

2. The method as recited in claim 1 where in step (b) a modified nitrocellulose propellant generates energy sufficient via said device to cause a turbulence within said gravel pack.

3. The method as recited in claim 1 where in step (b) the means for a modified nitroamine propellant generates energy via said device sufficient to cause a turbulence within said gravel pack.

4. The method as recited in claim 1 where in step (b) an unmodified propellant generates energy via said device sufficient to cause a turbulence within said gravel pack.

5. The method as recited in claim 1 where in step (b) a nitroglycerine and nitrocellulose double-based propellant generates energy via said device sufficient to cause a turbulence within said gravel pack.

6. The method as recited in claim 1 where in step (b) an ammonium perchlorate composite propellant with a rubberized binder generates energy via said device sufficient to cause a turbulence within said gravel pack.

7. The method as recited in claim 1 where in step (b) the generated energy is from about 1,000 psig to about 10,000 psig.

8. A high energy impulse method for removing voids in an in-casing gravel pack used in producing hydrocarbonaceous fluids from a subterranean formation via a deviated wellbore comprising:

(a) placing within a well, a high energy impulse device in proximity to a void containing in-casing gravel pack which encompasses a perforated production string;

(b) igniting said device which device upon ignition generates energy sufficient to cause turbulence within said gravel pack sufficient to consolidate gravel within said pack and remove voids therefrom without fracturing the formation, damaging the pack or production string assembly;

(c) determining the existence of an additional void in said pack; and (d) repeating steps (a), (b) and (c) until all voids are removed from said pack, thereby consolidating said pack and preventing fines from accumulating in a void.

9. The method as recited in claim 8 where in step (b) a modified nitrocellulose propellant generates energy sufficient to cause a turbulence within said gravel pack.

10. The method as recited in claim 8 where in step (b) a modified nitroamine propellant generates energy via said device sufficient to cause a turbulence within said gravel pack.

11. The method as recited in claim 8 where in step (b) an unmodified propellant generates energy via said device sufficient to cause a turbulence within said gravel pack.

12. The method as recited in claim 8 where in step (b) a nitroglycerine and nitrocellulose double-based propellant generates energy via said device sufficient to cause a turbulence within said gravel pack.

13. Th method as recited in claim 8 where in step (b) an ammonium perchlorate composite propellant with a rubberized binder generates energy via said device sufficient to cause a turbulence within said gravel pack.

14. The method as recited in claim 8 where in step (b) the generated energy is from about 1,000 psig to about 10,000 psig.

15. A high energy impulse method for removing voids in an in-casing gravel pack used in producing hydrocarbonaceous fluids from a subterranean formation via a deviated wellbore comprising:

(a) placing within a well, a high energy impulse device in proximity to a void containing in-casing gravel pack which encompasses a perforated production string; and (b) igniting said device which device upon ignition generates energy sufficient to cause turbulence within said gravel pack sufficient to consolidate gravel within said pack and remove voids therefrom without fracturing the formation, damaging the pack or production string assembly.

16. The method as recited in claim 15 where in step (b) a modified nitrocellulose propellant generates energy via said device sufficient to cause a turbulence within said gravel pack.

17. The method as recited in claim 15 where in step (b) a modified nitroamine propellant generates energy via said device sufficient to cause a turbulence within said gravel pack.

18. The method as recited in claim 15 where in step (b) an unmodified propellant generates energy via said device sufficient to cause a turbulence within said gravel pack.

19. The method as recited in claim 15 where in step (b) a nitroglycerine and nitrocellulose double-based propellant generates energy via said device sufficient to cause a turbulence within said gravel pack.

20. The method as recited in claim 15 where in step (b) an ammonium perchlorate composite propellant with a rubberized binder generates energy via said device sufficient to cause a turbulence within said gravel pack.

21. The method as recited in claim 15 where in step (b) the generated energy is from about 1,000 psig to about 10,000 psig.

22. The method as recited in claim 1 where in step a) said well is deviated.

23. The method as recited in claim 1 where the existence of an additional void is determined and steps (a) and (b) are repeated.

24. The method as recited in claim 1 where removal of a void prevents fines from accumulating in said void.

25. The method as recited in claim 15 where the existence of an additional void is determined and steps (a) and (b) are repeated.

26. The method as recited in claim 15 where removal of a void prevents fines from accumulating in said void.

* * * * *